US007681349B2

(12) United States Patent
Dicke et al.

(10) Patent No.: US 7,681,349 B2
(45) Date of Patent: Mar. 23, 2010

(54) HAND OPERATED TRAFFIC SIGNAL DEVICE

(75) Inventors: Grant D. Dicke, Downers Grove, IL (US); Richard Norman Dunbar, Wilmette, IL (US)

(73) Assignee: Dicke Tool Company, Downers Grove, IL (US)

( * ) Notice: Subject to any disclaimer, the term of this patent is extended or adjusted under 35 U.S.C. 154(b) by 0 days.

(21) Appl. No.: 12/070,989

(22) Filed: Feb. 22, 2008

(65) Prior Publication Data

US 2009/0078192 A1 Mar. 26, 2009

Related U.S. Application Data

(63) Continuation-in-part of application No. 11/901,987, filed on Sep. 20, 2007.

(51) Int. Cl.
*G09F 21/02* (2006.01)

(52) U.S. Cl. ..... 40/586; 403/377; 403/109.2; 340/908; 40/610

(58) Field of Classification Search ..... 40/606.01, 40/606.11, 606.18, 607.01, 607.03, 607.04, 40/607.05, 607.08, 586, 610, 612; 403/108, 403/109.2, 109.3, 109.5, 109.8, 359.1, 359.2, 403/286, 293, 298, 309, 310, 311; 138/155; 206/736–774; 135/114, 75; 248/527, 471, 248/145.6; 182/100, 113, 214
See application file for complete search history.

(56) References Cited

U.S. PATENT DOCUMENTS 4,235,033 A 11/1980 Eilers
5,117,765 A 6/1992 Wahl
5,381,707 A * 1/1995 Gill ..... 74/546
5,422,638 A 6/1995 Singer et al.
5,551,177 A 9/1996 Cowgill et al.
5,598,654 A 2/1997 Cowgill et al.
5,676,245 A * 10/1997 Jones ..... 206/223
5,694,711 A 12/1997 Cowgill et al.
5,729,926 A 3/1998 Cowgill et al.
6,003,256 A 12/1999 Leach et al.
6,104,313 A 8/2000 Boyd, II
6,134,819 A 10/2000 McClain et al.
6,134,820 A 10/2000 Martinez
6,147,623 A 11/2000 Rippen
6,150,957 A 11/2000 Henz et al.
6,179,514 B1 * 1/2001 Cheng ..... 403/377
6,204,777 B1 3/2001 Lyons
6,213,672 B1 * 4/2001 Varga ..... 403/109.2

(Continued)

*Primary Examiner*—Lesley Morris
*Assistant Examiner*—Shin Kim
(74) *Attorney, Agent, or Firm*—Olson & Cepuritis, Ltd.

(57) ABSTRACT

A hand-held ground-supported display device for warning passersby is disclosed. Included is a self-supporting sign panel and a plurality of at least three mast sections telescopically interfittable, one within the other. A coupler is attached to the sign panel, with a socket for releasably engaging the top mast section. The mast sections have progressively smaller internal diameters and progressively shorter lengths, with the outermost mast section having the largest internal diameter and the longest length. Middle mast upper and middle mast lower stop members are attached to upper and lower ends of the middle mast section, respectively. In one example, the middle mast upper stop member has an end wall with first and second sidewalls extending downwardly therefrom with lower free ends for interfering with stop members associated with the top and the bottom mast sections. A kit including the display device is also disclosed.

8 Claims, 17 Drawing Sheets

U.S. PATENT DOCUMENTS 6,363,641 B1 4/2002 Martinez
6,796,062 B1 * 9/2004 deKoevend ..... 40/586
7,073,228 B2 * 7/2006 Light ..... 16/429
7,198,425 B2 * 4/2007 Bergkvist et al. ..... 403/359.5

* cited by examiner

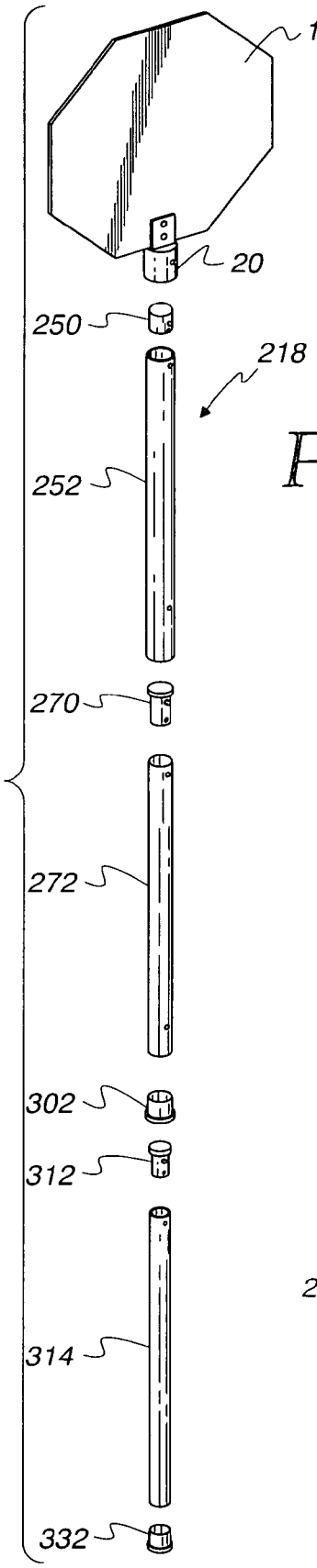
Fig. 25
Fig. 26
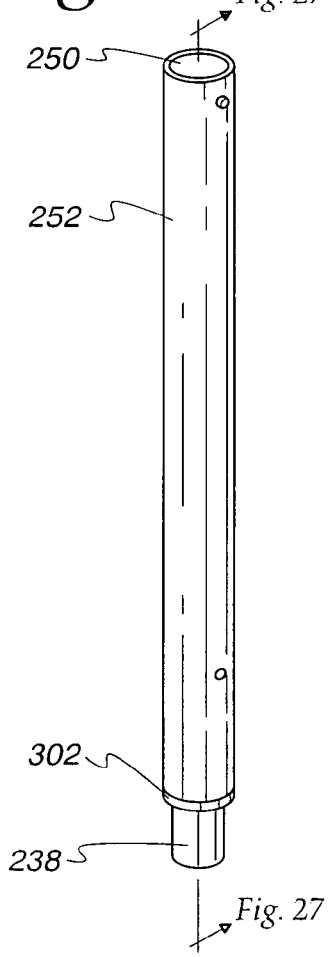
Fig. 27
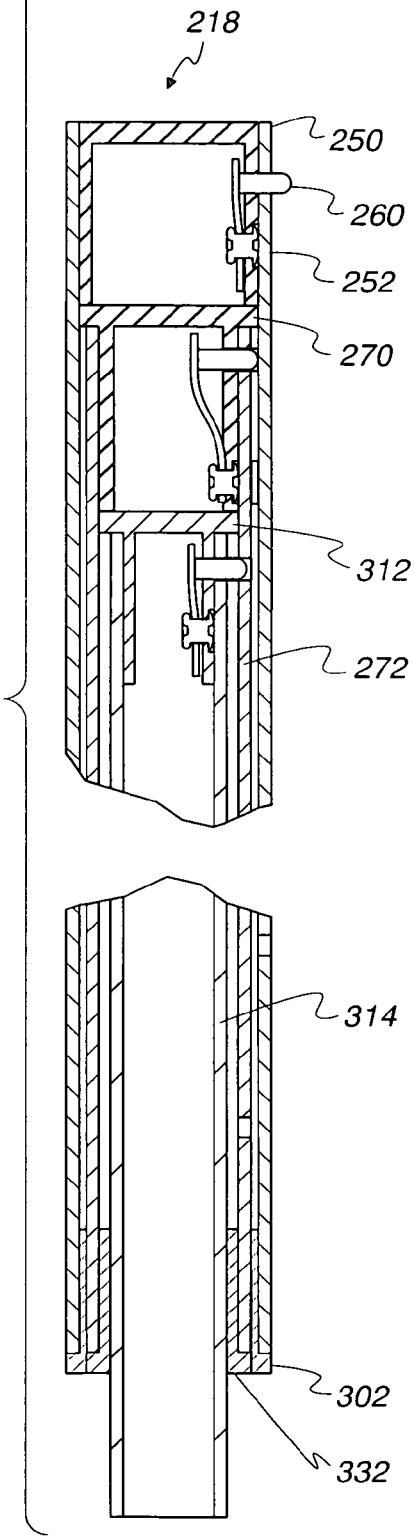

HAND OPERATED TRAFFIC SIGNAL DEVICE

CROSS-REFERENCE TO RELATED APPLICATION

This is a continuation-in-part of U.S. non-provisional patent application Ser. No. 11/901,987, filed Sep. 20, 2007, the disclosure of which is herein incorporated by reference as if fully set forth herein.

FIELD OF THE INVENTION

The present invention relates to the field of traffic signaling devices, and in particular to hand supported paddle signs.

BACKGROUND OF THE INVENTION

Safety warning equipment such as paddle signs bearing stop and slow designations have been developed using commonly available materials such as PVC water pipe and fittings therefor. Two messages are often incorporated on opposing sides of a rigid sign panel, referred to as a paddle. A safety officer, road worker or other operator need only rotate the sign mast to display the desired message to oncoming motorists. It is desirable to provide warning signs that are either hand held or rest on the ground so as to be ground-supported. In either application, an operator stands adjacent to a flow of traffic and at appropriate times rotates the sign to display one of the two messages to the motorists and others passing by.

The hand held signs have a short handle to reduce weight, while the ground-supported signs have a long mast, with one end supported by the ground and the other end supporting the paddle at approximately shoulder height. While the message panel can be the same for both types of signs, the remainder of the sign constructions is considerably different. The ground-supported signs may have a single relatively long pipe section. If the signs are to be shipped to a user, conventional coupling joints are provided to permanently secure sections of water pipe together, using adhesive bonding. Once erected, the resulting sign is rendered unsuitable for compact storage. If the couplers are left "dry," that is, unsecured, the loosely assembled pipe sections are not rendered suitably rigid and stable. Accordingly, ground supporting masts are made of one continuous pipe, eliminating the need for a coupling joints.

While signaling operations can be readily accomplished during ideal weather conditions and relatively light, slow moving traffic conditions, inclement weather and/or fast moving traffic can burden the operator, sometimes to an undesirable point of distraction. Contributing to the problem is the critical need for the operator to send the correct message at a given time. For example, it may be necessary to stop traffic to allow a workman to temporarily access the road surface, and only a command to stop is appropriate. In order to ensure that the proper signal is given, the operator must look away from oncoming traffic to concentrate visual focus on the message being displayed

SUMMARY OF THE INVENTION

The present invention provides a novel and an improved warning sign that minimizes the disadvantages associated with the prior art signs and provides advantages in construction, mode of operation and use. One embodiment of the invention provides a ground-supported sign capable of compact storage. Included is a hand-held ground-supported display device for warning passersby, with a self-supporting sign panel for displaying warning information, having opposed major surfaces and a maximum lateral dimension and a plurality of at least three mast sections telescopically interfittable, one within the other, including an upper, a lower and a middle mast section. A coupler is attached to the sign panel, with a socket for releasably engaging the top mast sections. The mast sections having progressively smaller internal diameters and progressively shorter lengths, with the outermost mast section having the largest internal diameter and the longest length, and middle mast upper and middle mast lower stop members attached to upper and lower ends of the middle mast section, respectively. The middle mast upper stop member having an end wall with first and second sidewalls extending downwardly therefrom and having lower free ends for interfering with stop members associated with the top and the bottom mast sections.

In another embodiment, a hand-held ground-supported display device for warning passersby is provided with a self-supporting sign panel for displaying warning information, having opposed major surfaces and a maximum lateral dimension, a plurality of at least three mast sections telescopically interfittable, one within the other, including an upper, a lower and a middle mast section and a coupler attached to the sign panel, with a socket for releasably engaging the top mast sections. The mast sections have progressively smaller internal diameters and progressively shorter lengths, with the outermost mast section having the largest internal diameter and the longest length, middle mast upper and middle mast lower stop members attached to upper and lower ends of the middle mast section, respectively, and the middle mast upper stop member having a sidewall extending downwardly from and enlarged end wall having an outer periphery with upper and lower surfaces at the outer periphery for interfering with stop members associated with the top and the bottom of the upper mast section. In one example, the sidewall of the middle mast upper stop member has a lower free end that contacts a stop member carried on the top of the lower mast section.

In another example, a kit for a hand-held display device for warning passersby is provided with a self-supporting sign panel for displaying warning information, having opposed major surfaces and a maximum lateral dimension. A plurality of at least three mast sections are telescopically interfittable, one within the other, a coupler is attached to the sign panel, with a socket for releasably engaging one of the mast sections, and the mast sections having a length that is not substantially greater than said maximum lateral dimension. A carton for containing said sign panel, said coupler and said plurality of mast sections is also provided. In one example, the mast sections have different lengths and in another example, the mast sections have progressively shorter lengths, with the outermost mast section having the greatest length;

In a further embodiment, a hand-held ground-supported display device is provided for warning passersby. Included is a self-supporting sign panel for displaying warning information, having opposed major surfaces and a maximum lateral dimension, and a plurality of at least three mast sections telescopically interfittable, one within the other, including an upper, a lower and a middle mast section. A coupler attached to the sign panel, has a socket for releasably engaging the upper mast section, and the mast sections having progressively smaller internal diameters and progressively shorter lengths, with the outermost mast section having the largest internal diameter and the longest length. A middle mast upper stop member is attached to the upper end of the middle mast section, and a middle mast lower stop member is attached to the lower end of the middle mast section. The middle mast upper stop member has an end wall with at least one sidewall extending downwardly therefrom so as to define three stop surfaces, with one stop surface facing upwardly to contact the upper mast section, one stop surface facing downwardly to contact a stop member carried on the middle mast section and one stop surface facing downwardly to contact the lower mast section. In one example, the middle mast upper stop member has an end wall with first and second sidewalls extending downwardly therefrom, and the first and the second sidewalls have lower free ends for interfering with stop members associated with the top and the bottom mast sections. In another example, the middle mast upper stop member has an end wall with a sidewall extending downwardly therefrom. The end wall has an upwardly facing top surface, with the end wall overhanging the sidewall with an overhanging portion having a downwardly facing stop surface. The sidewall has a downwardly facing bottom stop surface.

BRIEF DESCRIPTION OF THE DRAWINGS

In the drawings:

FIG. 25 is an exploded perspective view of an alternative sign panel assembly;

FIG. 26 is a perspective view of the mast thereof;

FIG. 27 is a fragmentary cross-sectional view taken along the line 27-27 of FIG. 26;

DESCRIPTION OF THE PREFERRED EMBODIMENTS

Figure 1:
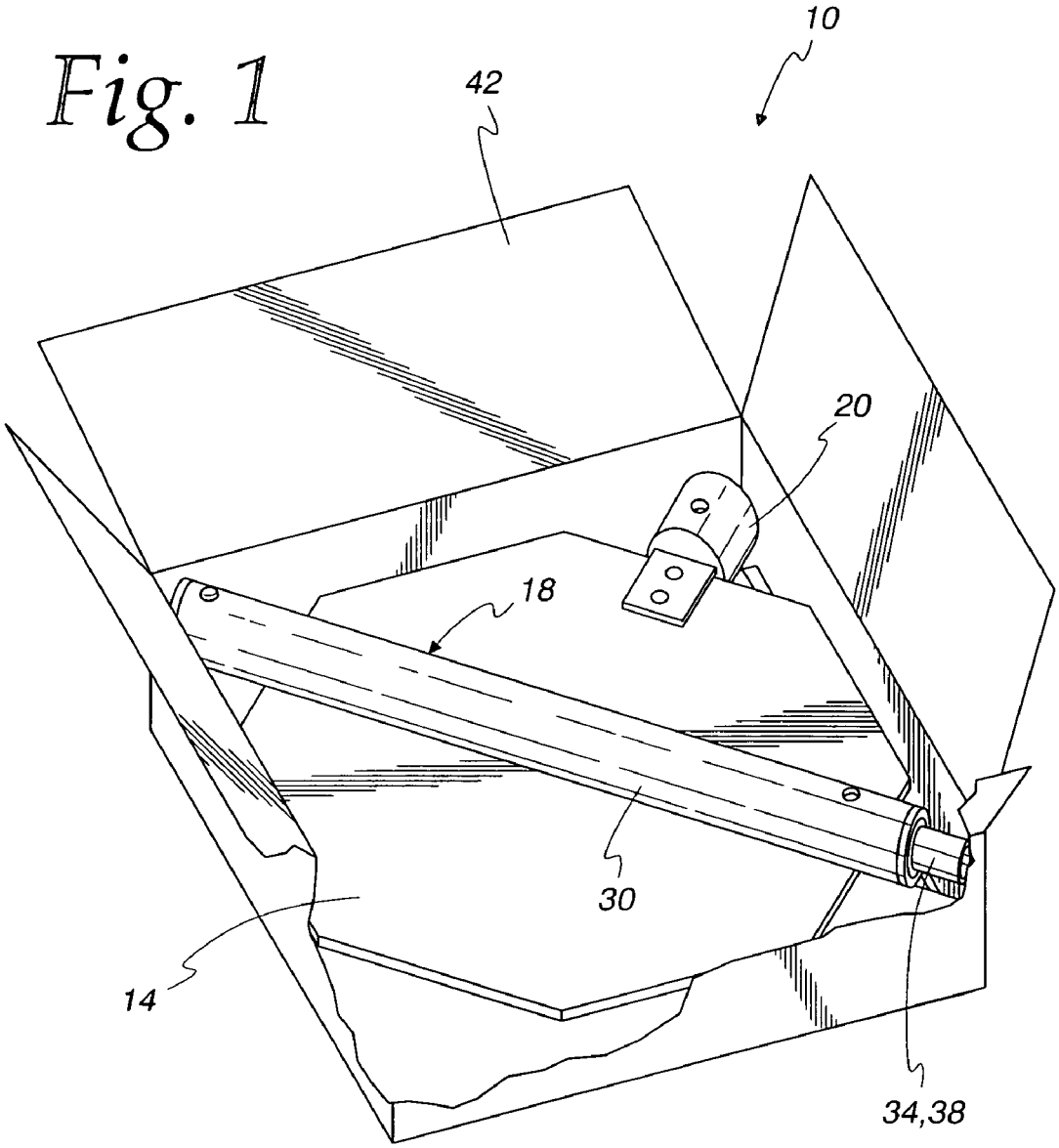
FIG. 1 is a perspective schematic illustration of a sign kit according to the present invention.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments.

For ease of description, sign equipment utilizing a display device embodying the present invention is described herein below in its usual assembled position as shown in the accompanying drawings, and terms such as upper, lower, horizontal, longitudinal, etc., may be used herein with reference to this usual position. However, the sign equipment may be manufactured, transported, sold, or used in orientations other than and described and shown herein.

Referring to FIGS. 1-4, apparatus embodying the present invention provides a kit 10 for a signal device 12, preferably used to warn oncoming motorists and others of a nearby conflict with a normal traffic flow, and the need to obey directions to alter traffic flow. Although the signal device 12 can be used for a variety of purposes, it has become customary to display either a "SLOW" message on either side of a rigid sign panel or paddle 14. The same signal device may be rotated to display one of the two messages.

One embodiment of the signal device 12 comprises an octagonal sign panel 14, which is sufficiently rigid so as to be self supporting. In one example, the message indicia is inked, painted, or otherwise affixed to a self supporting backer board. In another example, not shown, the message indicia are displayed on flexible sign panel material and are supported by a suitable frame. Signal device 12 includes a mast 18 that is joined to the sign panel 14 by a coupler 20, using conventional fasteners, such as bolts, rivets or adhesive.

The mast 18 is provided with a plurality, preferably three, interfitting sections, including upper, middle and lower mast sections 30, 32 and 34. Preferably, the mast sections are telescopically interfittable, one within the other, A number of examples are possible, including, in a first example, mast sections having different lengths; in a second example, mast sections having progressively shorter lengths, and in a third example, the mast sections have progressively smaller internal diameters and shorter lengths, with the outermost mast section having the largest internal diameter and the longest length.

Figure 2:
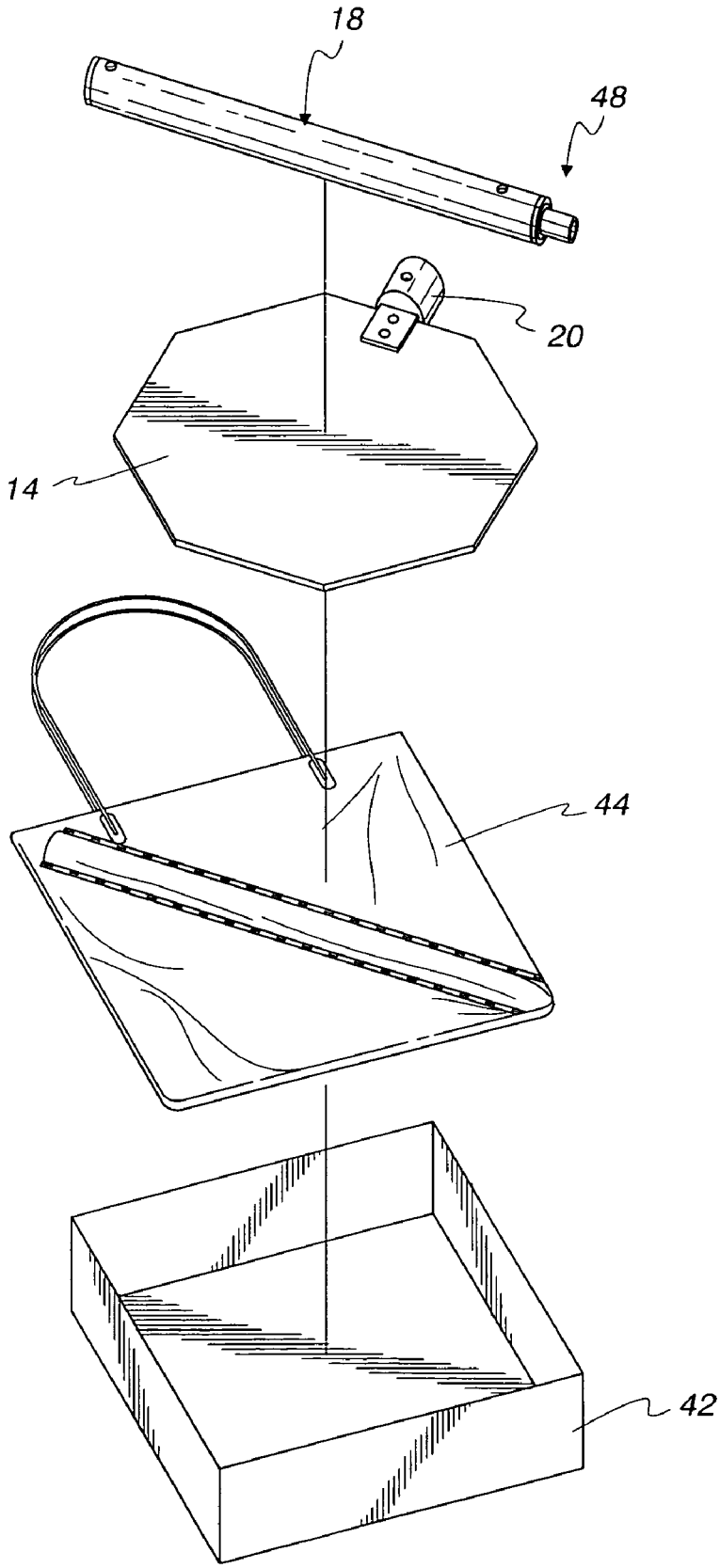
FIG. 2 is an exploded perspective view thereof.
Figure 3:
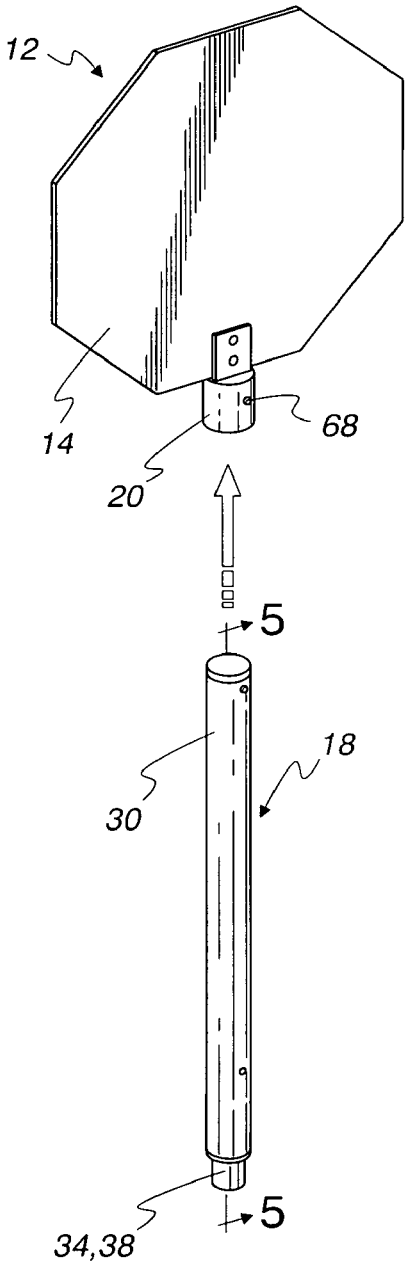
FIG. 3 is an exploded perspective view showing assembly of the sign panel.
Figure 4:
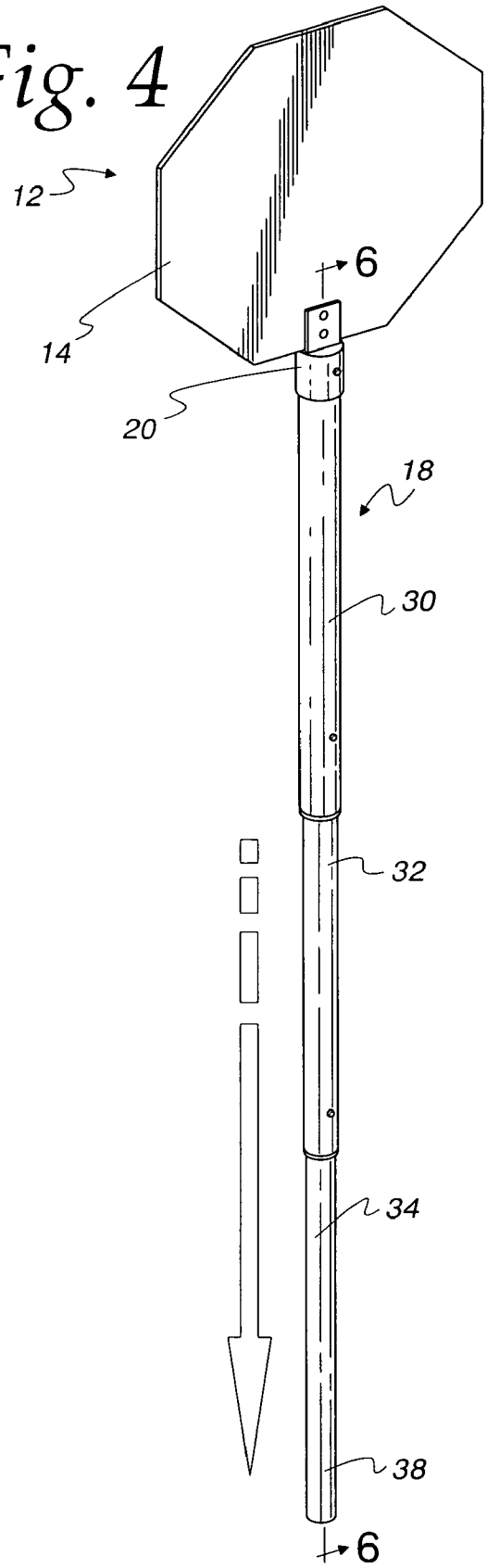
FIG. 4 is a perspective view showing deployment of the sign panel.
Figure 5:
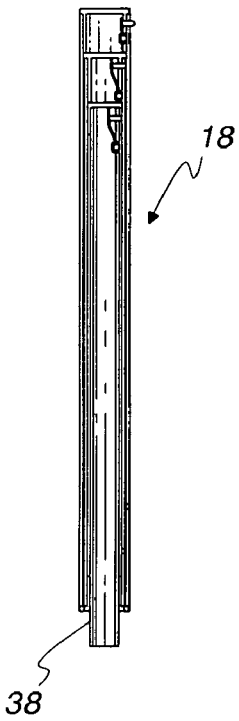
FIG. 5 is a cross-sectional view taken along the line 5-5 of FIG. 3.
Figure 6:
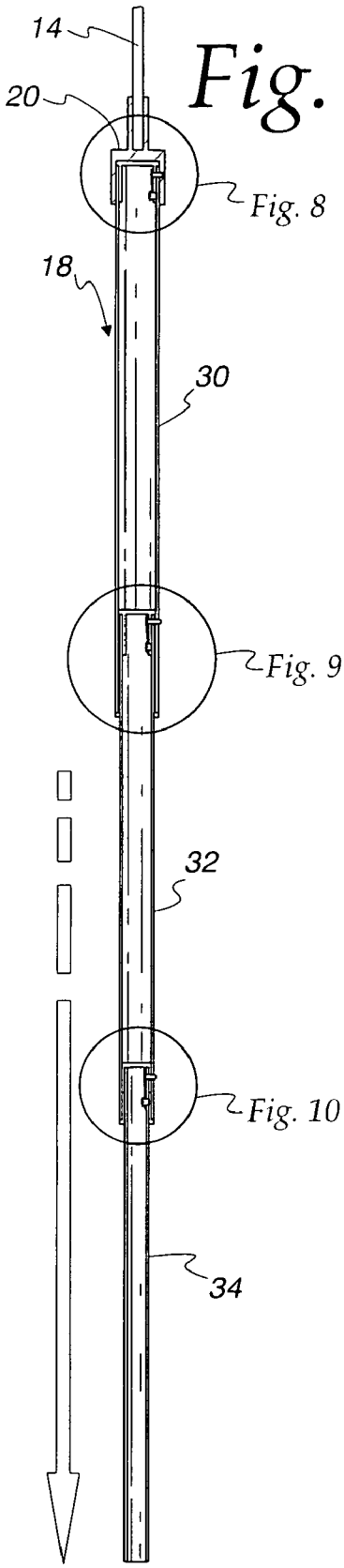
FIG. 6 is a cross-sectional view similar to that of FIG. 5, but showing the sign panel in a deployed position.
Figure 8:
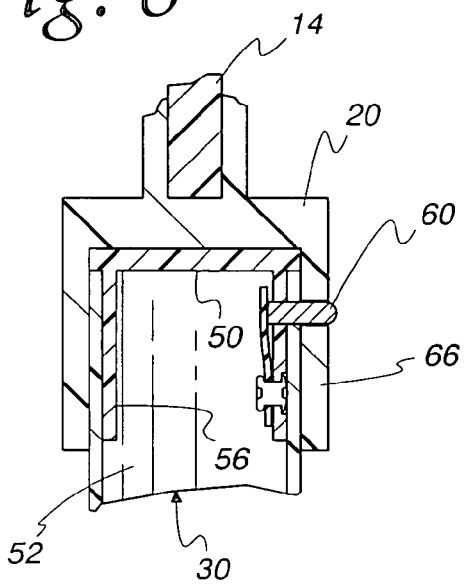
FIGS. 8-10 are cross-sectional views showing fragments of FIG. 6.
Figure 9:
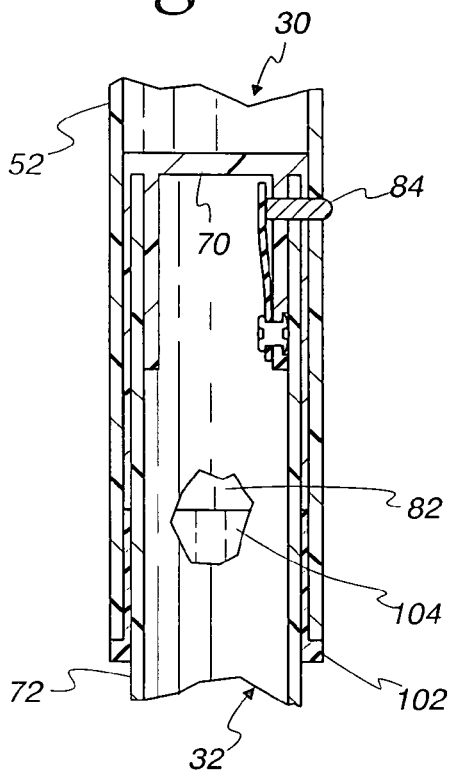
Figure 10:
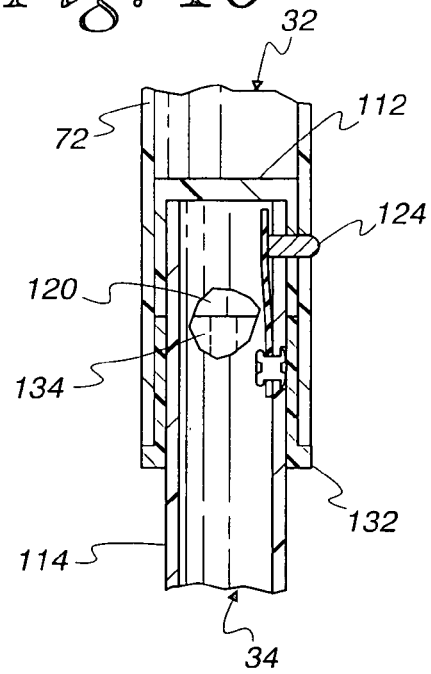
Figure 11:
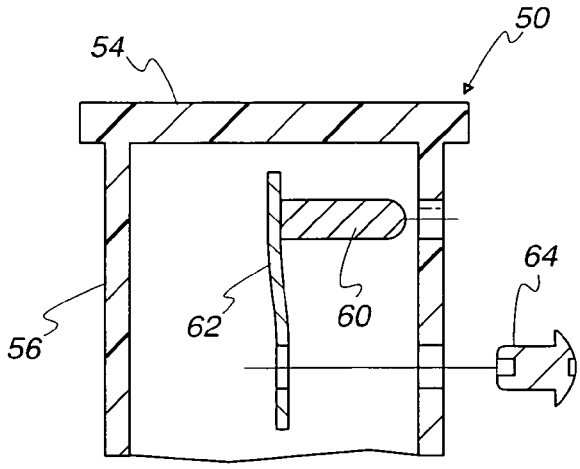
FIG. 11 is a fragmentary exploded perspective view showing one of the cap assemblies of FIG. 7.
Figure 12:
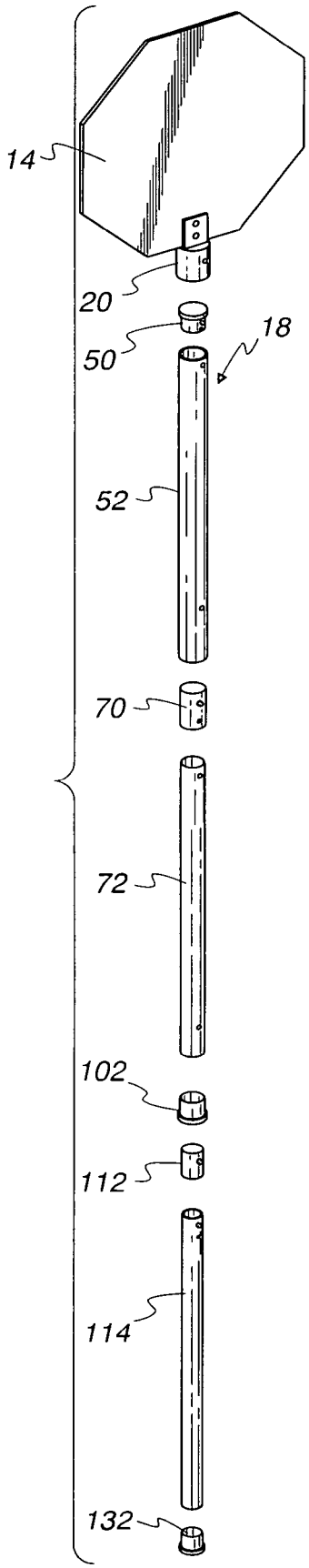
FIG. 12 is an exploded perspective view of the sign panel assembly.
Figure 13:
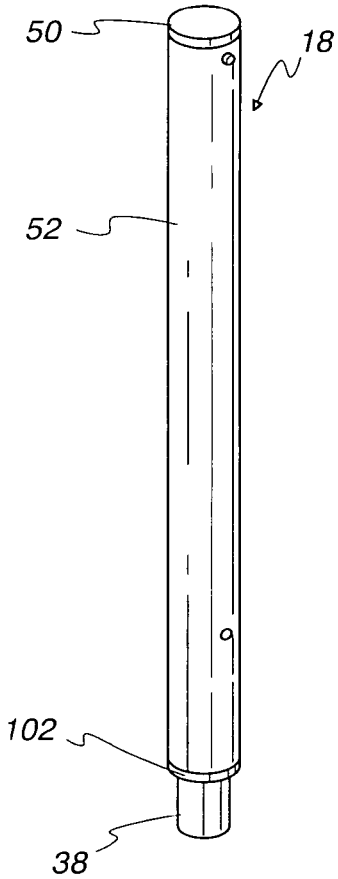
FIG. 13 is a perspective view of the mast thereof.
Figure 14:
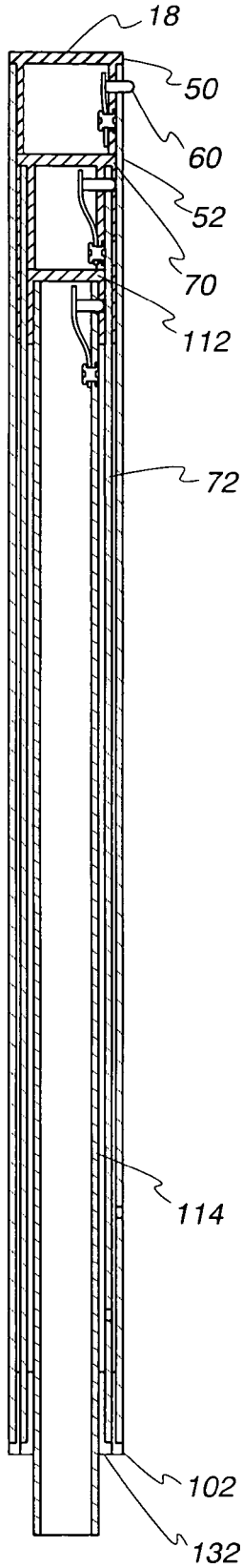
FIG. 14 is a cross-sectional view taken along the line 14-14 of FIG. 13.

Referring, for example to FIGS. 3 and 5, the mast is preferably collapsible so as to almost fit entirely within the outermost mast section 30. Preferably, when in the fully collapsed position of FIGS. 3 and 5, a small portion 38 of the lower mast section 34 protrudes from the mast section 30, to provide a convenient manually graspable handhold for extending the mast sections to the fully extended position shown for example, in FIG. 4. With reference to FIG. 1 in the fully collapsed position illustrated in FIG. 3, mast 18 presents a package of maximum compactness, preferably dimensioned to fit generally within the lateral extent of the sign panel 14, suitable for compact shipping in a carton 42 of minimal size. With reference to FIG. 2, a carrying bag 44, with separate pockets for the sign panel and mast may also be provided to form a second kit 48. For comparison purposes, FIGS. 5 and 6 are drawn to the same scale, Referring now to FIGS. 6-10, mast 18 is preferably comprised of three, interfitting, telescoping sections 30-34, that have progressively smaller internal diameters and progressively shorter lengths, with the outermost mast section 30 having the largest internal diameter and the longest length. If desired, the middle and the lower mast sections 32, 34 could be dimensioned to fit entirely within upper mast section 30, but lower mast section 34 is preferably extended so that a small portion 38 protrudes from the fully collapsed mast assembly indicated at 18 in FIG. 7, to provide for easy extraction, as when deployment of the signal device is desired. FIG. 6 indicates that the enlarged views of FIGS. 8-10 show upper portions of the mast sections 30-34, respectively. Referring now to FIGS. 8 and 11, upper mast section 30 includes an end cap 50 that encloses the upper end of the tubular body 52. As can be seen in FIG. 11, end cap 50 includes an end wall 54 that extends slightly beyond tubular body 56 of the end cap. A stop pin 60 is carried at one end of a finger-like spring bias member 62, that is secured to tubular body 56 by a rivet or other fastener 64. Referring to FIG. 8, stop pin 60 is dimensioned to extend through tubular body 52 of the mast section as well as sidewall 66 of coupler 20. Thus, stop pin releasably secures socket 20 to upper mast section 30. It is generally preferred that socket 20 be provided with a hole 68 for this purpose (see FIG. 1).

Figure 7:
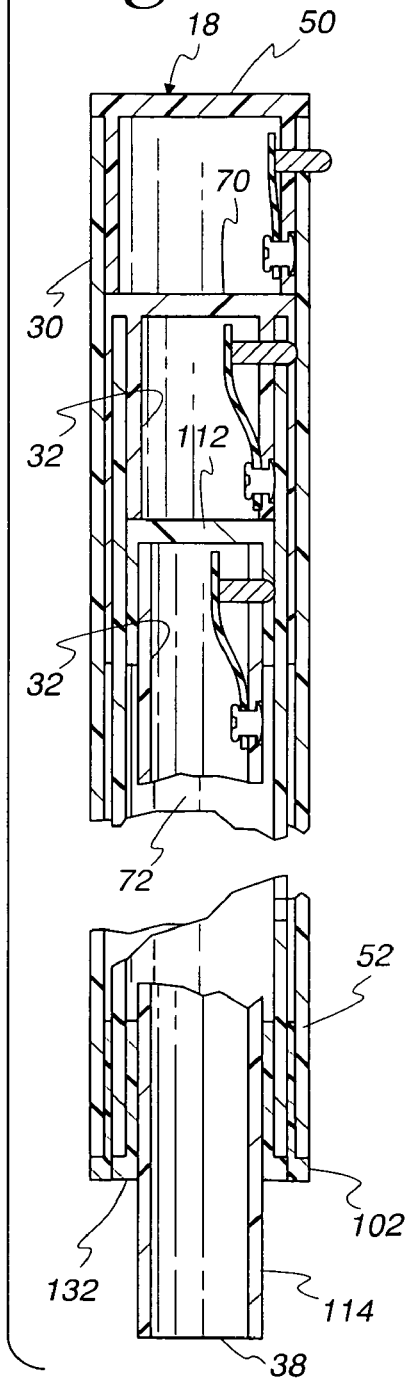
FIG. 7 is a cross-sectional view showing a portion of FIG. 5, taken on an enlarged scale.
Figure 19:
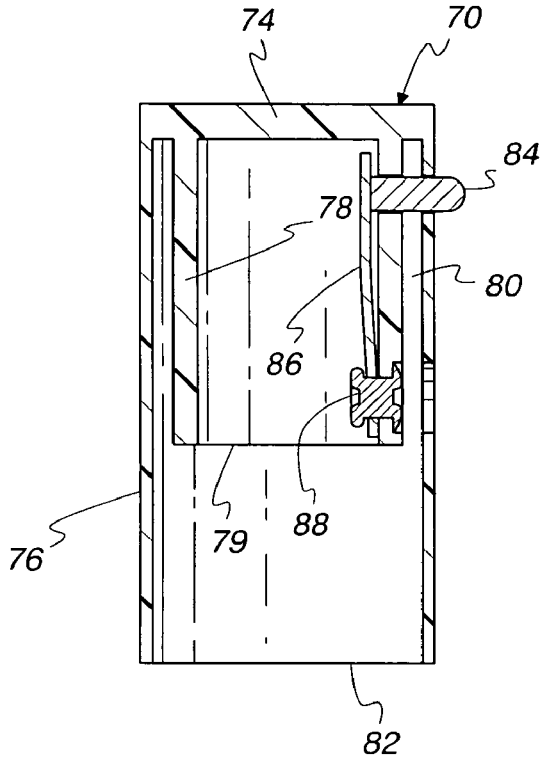
FIG. 19 is a fragmentary cross-sectional view taken along the line 21-21 of FIG. 17.

Referring now to FIGS. 9 and 19, the upper end of middle mast section 32 is enclosed by double wall cap 70, joined to the upper end of tubular body 72 of middle mast section 32 (see FIG. 7). As can be seen in FIG. 19, cap 70 includes and end wall 74, from which sidewalls 76, 78 depend, extending in a downward direction. Preferably, inner sidewall 78 has a smaller diameter and shorter length, compared to outer sidewall 76. As can be seen in FIG. 19, a lower end 82 of outer sidewall 76 extends below the bottom of inner sidewall 78. A gap 80 is formed between sidewalls 76, 78 to receive the upper end of tubular body 72, in the manner illustrated in FIG. 9. A stop pin 84 is carried at one end of spring bias member 86, and a rivet 88 or other conventional fastener secures the remaining end of bias member 86 to sidewall 78. Preferably, stop pin 84 is dimensioned to extend through both sidewalls 76, 78 (see FIG. 9) and tubular wall 52 of upper mast section 30 (see FIG. 9).

Figure 17:
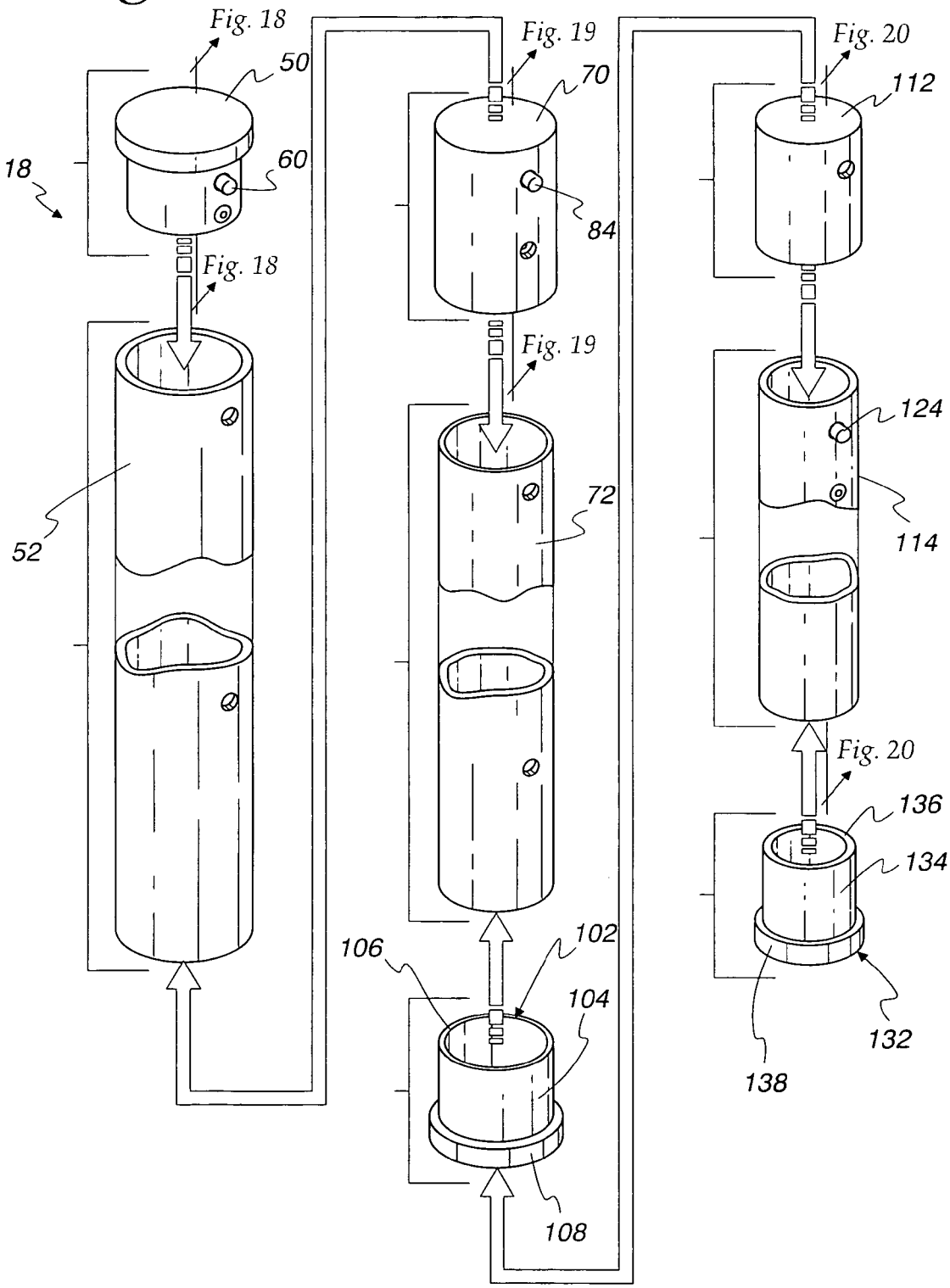
FIG. 17 is a fragmentary exploded perspective view showing assembly of the mast of FIG. 13.
Figure 18:
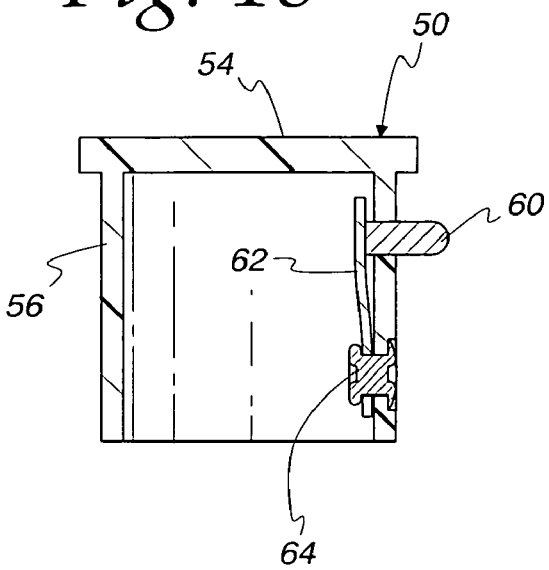
FIG. 18 is a fragmentary cross-sectional view taken along the line 20-20 of FIG. 17.

Referring now to FIGS. 9 and 17, a stop member 102 is secured at the bottom end of tubular body 52, using adhesive or other conventional fastener. As can be seen in FIG. 17, stop member 102 has a sidewall 104 with an upper end 106 and an enlarged collar 108 at its lower end, to interfere with the bottom end of tubular body 52, thus limiting the amount of insertion of sidewall 104 into tubular body 52. Sidewall 104 has an internal bore dimensioned to receive tubular body 72, but not the outer sidewall of cap 70. Thus, with reference to FIG. 9, stop member 102 traps cap 70 within the tubular body 52 of upper mast section 30.

Figure 20:
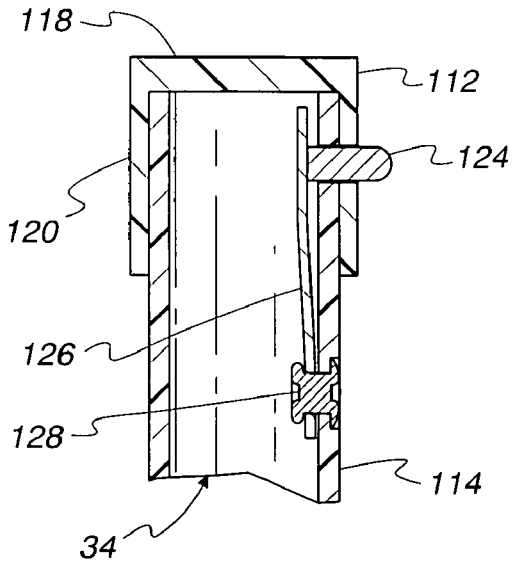
FIG. 20 is a fragmentary cross-sectional view taken along the line 22-22 of FIG. 17.

Turning now to FIGS. 10 and 20, an end cap 112 encloses the upper end of tubular body 114 of lower mast section 34. As can be seen in FIG. 20, end cap 112 includes an end wall 118, from which a sidewall 120 depends. Preferably, sidewall 120 is flush with end wall 48, to eliminate an overhanging end wall, although an overhang could be provided, if desired. A stop pin 124, carried at one end of spring bias member 126 is dimensioned to pass through tubular body 114 as well as sidewall 120 and beyond, past sidewall 72 (see FIG. 10).

Referring now to FIGS. 10 and 17, a stop member 132 is affixed to the bottom end of tubular body 72 of middle mast section 32, preferably using an adhesive, although other conventional fasteners could be employed, as well. As can be seen in FIG. 17, stop member 132 includes a sidewall 134 having an upper end 136, and an enlarged collar 138. With reference to FIG. 10, sidewall 134 has an internal bore for receiving the tubular wall 14 of lower mast section 34, while being dimensioned for insertion into the bottom end of tubular wall 72 of middle mast section 32. enlarged collar 138 limits this insertion. Thus, stop member 132 traps cap 112 within tubular body 72 of middle mast section 32.

Figure 15:
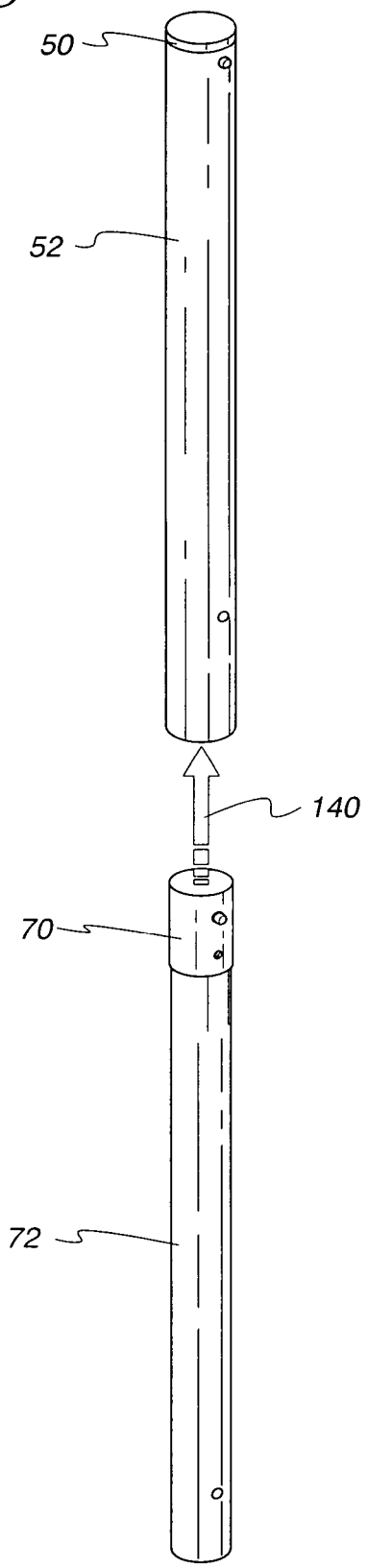
FIGS. 15 and 16 are exploded perspective views showing assembly of the mast of FIG. 13.
Figure 16:
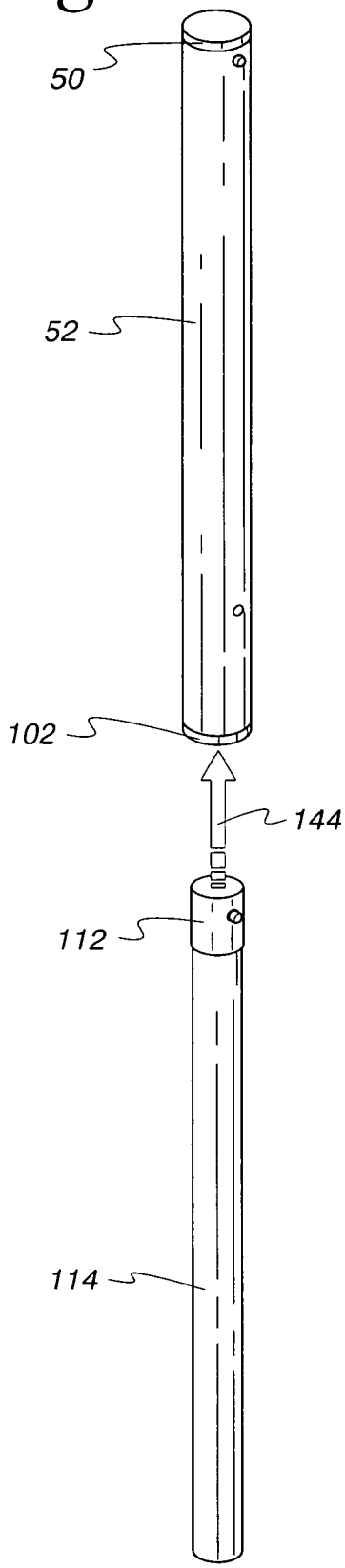

With reference to FIGS. 15-17, assembly of signal device 12 begins with subassembly of the mast sections 30-34, exclusive of the stop members 102, 132 that form part of the upper and middle mast sections 30, 32, respectively. As indicated in FIG. 15, end cap 50 is fitted to tubular body 52. Double wall cap 70 is fitted to the upper end of tubular wall 72, and the subassembly is inserted into the lower end of tubular wall 52, as indicated by arrow 140 of FIG. 15, to form the subassembly shown at the top portion of FIG. 16. Thereafter, end cap 102 is secured to the bottom end of tubular body 52, trapping end cap 70 within tubular wall 52. End cap 112 is then fitted to the upper end of tubular sidewall 114, and the resulting subassembly is then inserted into the bottom end of tubular body 72, passing in the direction of arrow 144 (see FIG. 16), through the inner bore of stop member 102 (see FIG. 7). Before tubular body 72 is fully inserted, stop member 132 is affixed to its bottom end, using adhesive or other fasteners. As can be seen, for example, in FIG. 7, stop member 132, while being free to pass within stop member 102, traps end cap 112 within tubular body 72. The bottom edge 79 of sidewall 78 (see FIG. 19) provides an upper stop for end cap 112 (see also FIG. 7).

Figure 21:
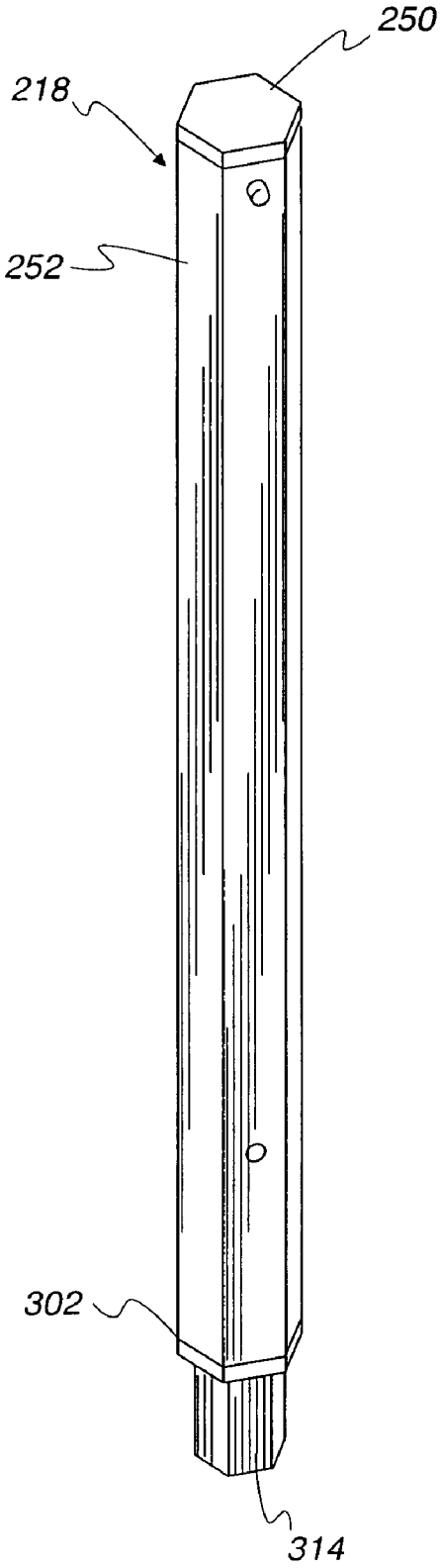
FIG. 21 is a perspective view of an alternative embodiment of the mast.
Figure 22:
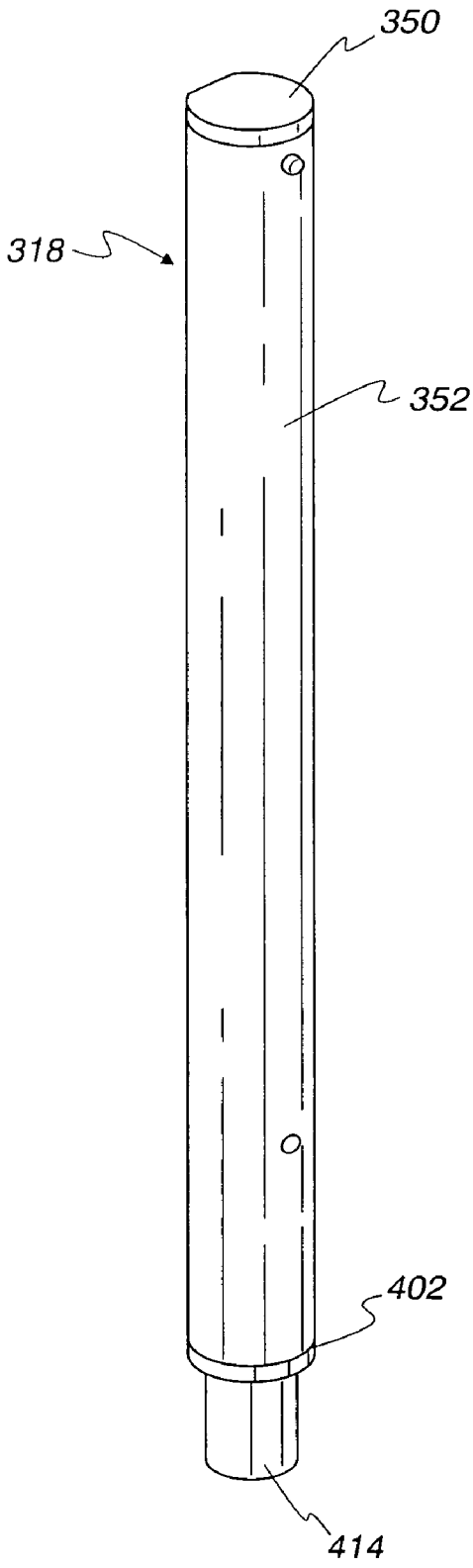
FIG. 22 is a perspective view of another alternative embodiment of the mast.

Referring now to FIGS. 21 and 22, alternative embodiments of the signal device mast are shown. Masts 218, 318 are substantially identical to mast 18 described above, except that the cross-sectional shapes are not circular as with the tubular bodies, end caps and stop members of mast 18. Rather, mast 218 employs components that have an octagonal cross-sectional shape and mast 318 has components that have a "D" shaped cross-section. Accordingly, the tubular bodies 252, 314, the end cap 250 and the stop member 302 have octagonal cross-sectional shapes. The inner bore of stop member 302 and the inner bore of the remaining components, where necessary, have octagonal shapes. The octagonal shapes aid a user in obtaining a manual grasp while rotating the mast to alternate the message of the sign panel carried atop the mast. If desired, only the outermost tubular body 252 and the associated end cap 250 could be made octagonal, with the remaining components having circular cross-sections, if desired. For example, the inner bore of stop member could be circular, while its outer shape could be octagonal. Cross-sectional shapes with other numbers of sides are also contemplated by the present invention.

Referring to FIG. 22, the cross-sectional shapes employed in the various components of mast 318 need not be symmetrical, but could be "D" shaped, for example, as shown. The "D"

shape of tubular body 352 aids in gaining a manual grasp of the mast for rotation about a longitudinal axis, and also provides tactile indication of which of the two faces of the sign panel are facing in the direction of traffic at any given time. In FIG. 22, the end cap 350, the stop member 402 and the tubular bodies 352, 414 of the upper and lower mast sections all have a "D" shape. If desired, the middle and lower mast sections could have circular cross-sectional configurations, if desired, with the inner bore of stop member 402, for example, being made circular.

Figure 23:
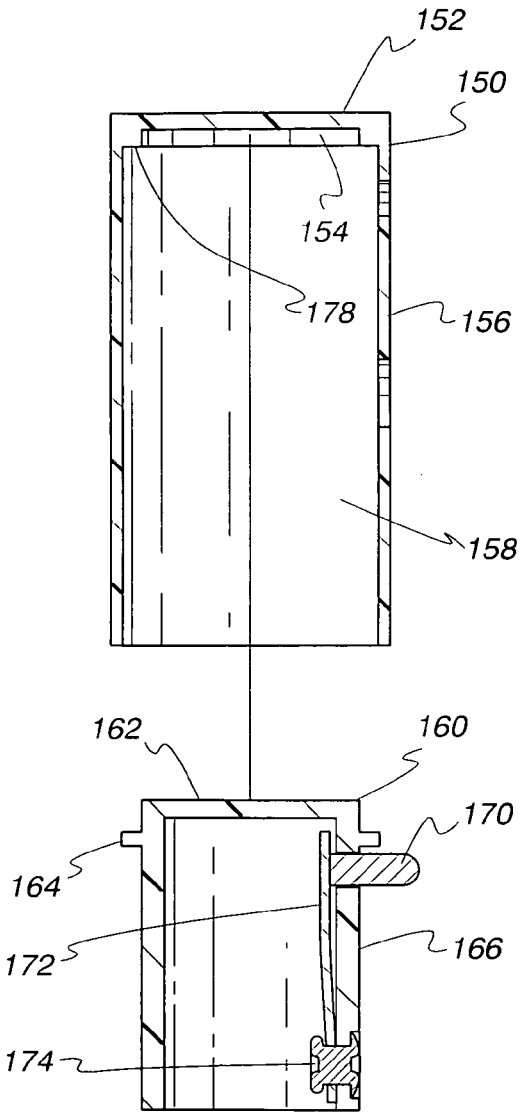
FIG. 23 is a cross-sectional view of an alternative embodiment of the section cap of FIG. 21.
Figure 24:
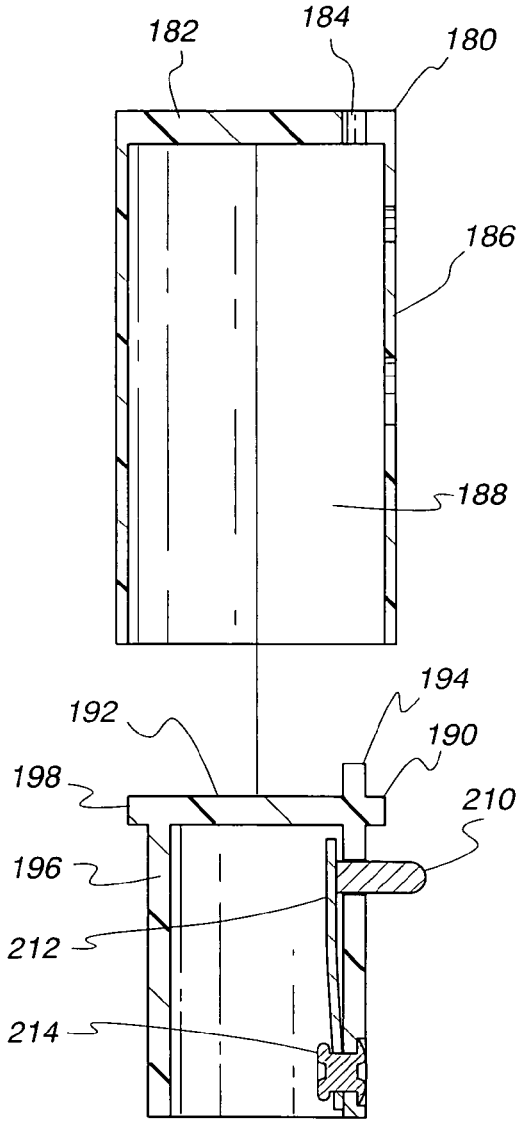
FIG. 24 is a cross-sectional view of another alternative embodiment of the section cap of FIG. 21.

Referring now to FIGS. 23 and 24, alternative constructions for the double wall cap 70 are shown. As with the other components described herein, the double wall cap 70 of FIG. 19 is most preferably constructed as a monolithic molding of plastic resin, utilizing virtually any resin composition known today. If desired, the components can be formed by assembling separate constituent moldings, using adhesive, sonic or thermal welding or the like, for example. Two examples of such assemblies are given in FIGS. 23 and 24, both of which illustrate alternative constructions of the double wall cap 70 of FIG. 19. Referring to FIG. 23, an outer shell 150 includes an upper wall 152 with an internal, downwardly opening recess 154, and a sidewall 156, cooperating to form a hollow interior 158. An inner shell 160 has an upper wall 162, an seating ring 164 disposed below the upper surface of upper wall 162, and a sidewall 166. A stop pin 170 is carried at one end of spring bias member 172, and a rivet 174 or other conventional fastener secures the remaining end of bias member 172 to sidewall 166. Inner shell 160 is inserted within outer shell 150, until upper wall 162 is at least partly received within recess 154, and secured with a suitable joinder, using conventional techniques. Preferably seating ring contacts inside wall surface 178 disposed on either side of recess 154 to control the depth of insertion of wall 162 within recess 154, to align the longitudinal axes of shells 150, 160 and to provide optional, additional support and adhesion between the shells 150, 160 as may be desired. When assembled, the shells 150, 160 join to form a structure substantially identical to the double wall cap 70 of FIG. 19. Using the assembly techniques according to FIG. 23, more cost effective molding techniques may be employed, since the shells 150, 160 have a relatively uniform thickness throughout.

Referring to FIG. 24 another alternative construction of the double wall cap 70 of FIG. 19 includes an outer shell 180 with an upper wall 182 with an optional recess or hole 184, and a sidewall 186, cooperating, to form a hollow interior 188. An inner shell 190 has an upper wall 192, and an optional, upwardly extending locating pin 194 disposed above the upper surface of upper wall 192. A sidewall 196 extends downwardly from upper wall 192, and is recessed so as to extend inwardly from upper sidewall outer edge 198, which is dimensioned for a close tolerance fit with the inner surface of sidewall 186. A stop pin 210 is carried at one end of spring bias member 212, and a rivet 214 or other conventional fastener secures the remaining end of bias member 212 to sidewall 196. Inner shell 190 is inserted within outer shell 180, until upper wall 192 of inner shell 190 contacts the inside surface of wall 182 of outer shell 180, with the outer edge 198 of inner shell 190 contacting the inner surface of sidewall 186, so as to align the longitudinal axes of outer and inner shells 180, 190. If desired, locating pin may be provided for additional contact and alignment of the outer and inner shells. Preferably, pin 194 is received in hole 184 with a tight fit, to provide further contact and alignment of the outer and inner shells. If desired, more than one locating pin may be employed, the locating pin(s) may be located on upper wall 182, and may be received in recesses, rather than holes. By using one locating pin, or by arranging a plurality of pins on either wall 180 or 190, the angular positioning and alignment between shells 180, 190 can be fixed in a known and repeatable manner, further aiding assembly.

Figure 28:
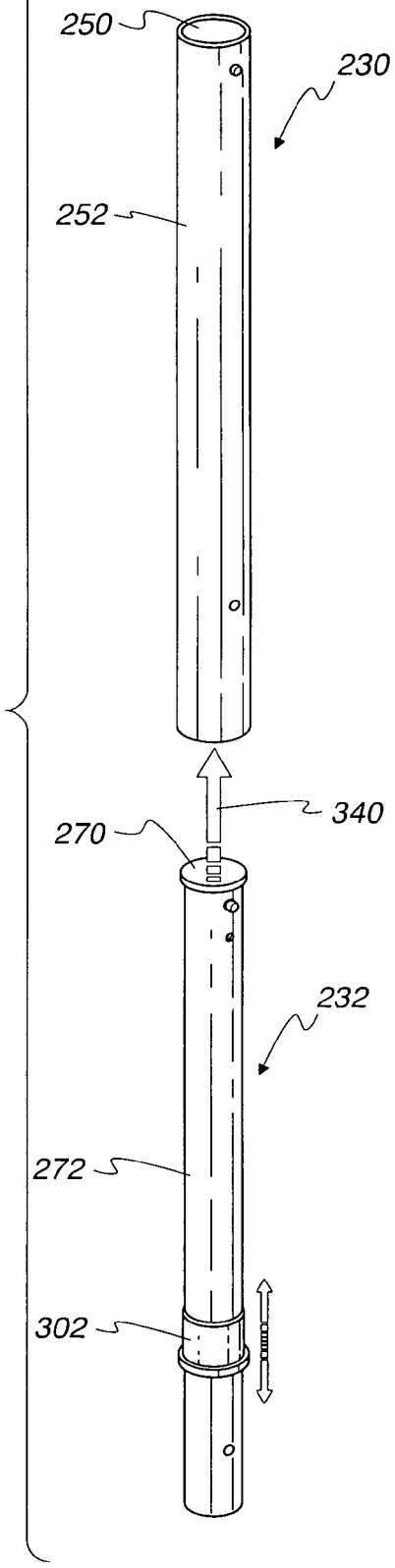
FIGS. 28 and 29 are exploded perspective views showing assembly of the mast of FIG. 27.
Figure 29:
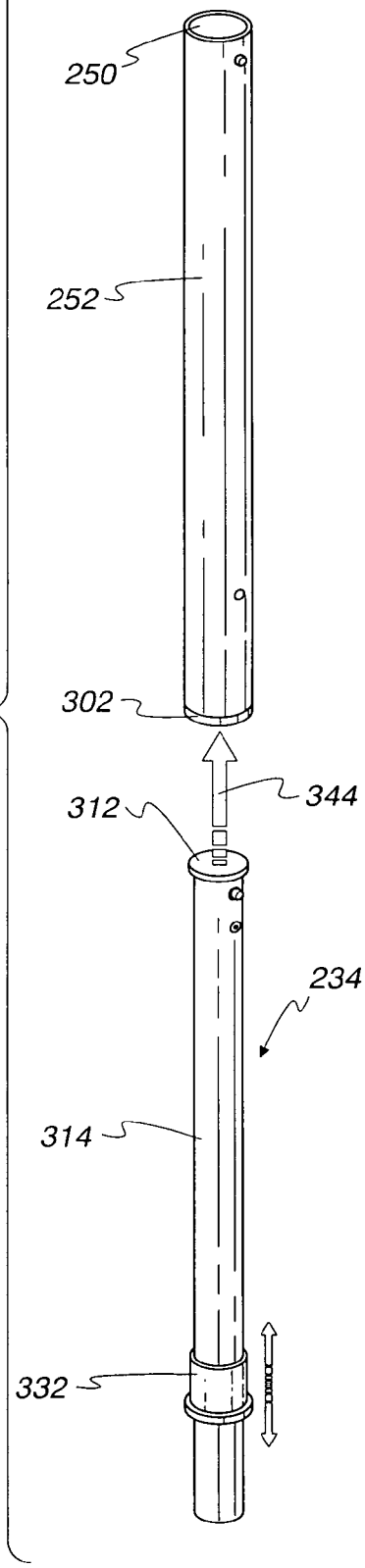

Turning now to FIGS. 25-36, an alternative mast construction is indicated at 218. As will be seen, mast 218 is constructed in a manner similar to mast 18 described above, using several different components so as to achieve an improved axial or longitudinal compactness when collapsed for storage, as depicted in FIGS. 26 and 27. Referring now to FIGS. 28-29, mast 218 is preferably comprised of three, interfitting, telescoping sections 230-234, that have progressively smaller internal diameters and progressively shorter lengths, with the outermost mast section 230 having the largest internal diameter and the longest length. If desired, the middle and the lower mast sections 232, 234 could be dimensioned to fit entirely within upper mast section 230, but lower mast section 34 is preferably extended so that a small portion 238 protrudes from the fully collapsed mast assembly indicated at 238 in FIG. 26, to provide easy extraction, as when deployment of the signal device is desired.

Figure 30:
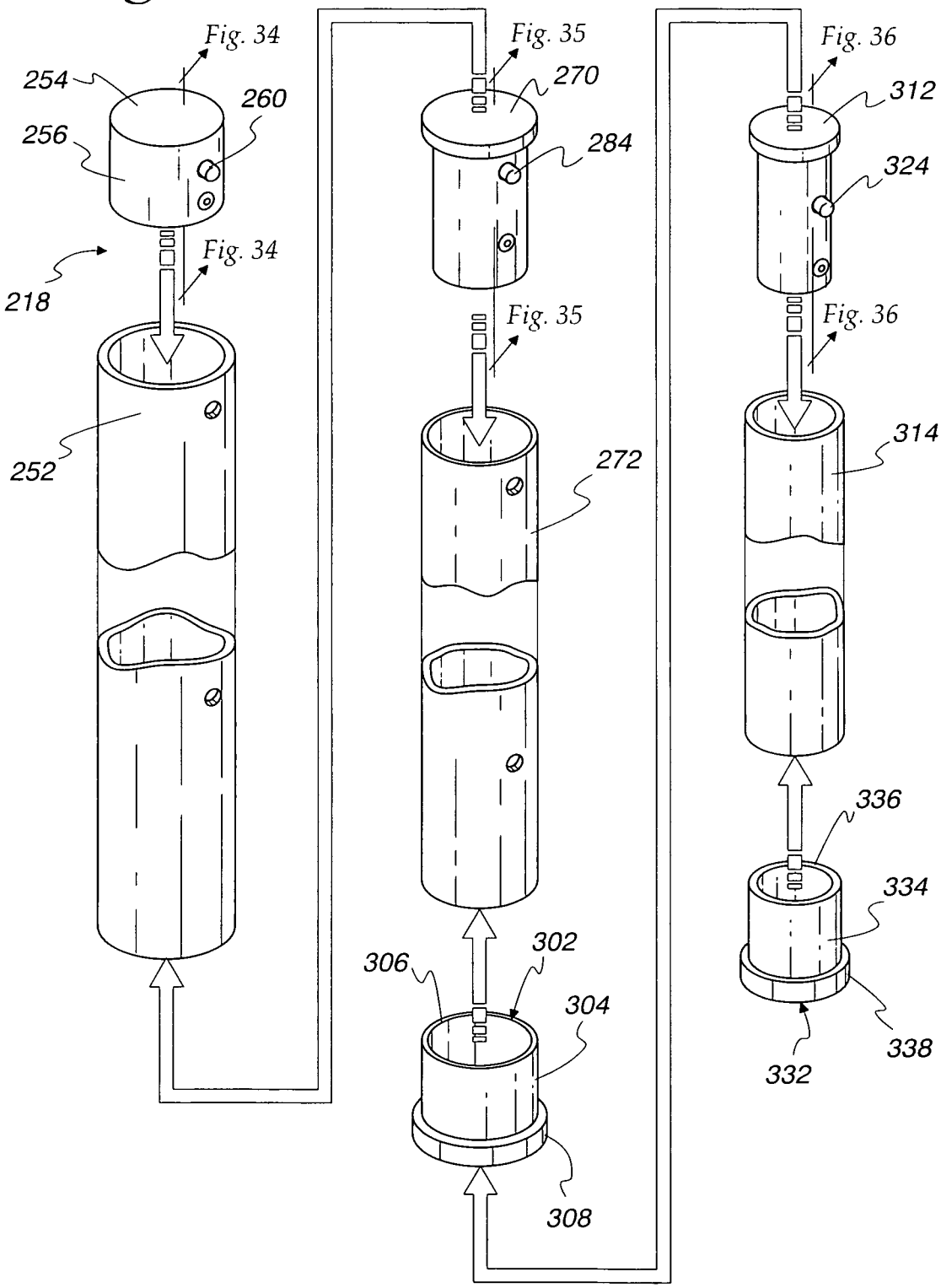
FIG. 30 is a fragmentary exploded perspective view showing assembly of the mast of FIG. 27.
Figure 31:
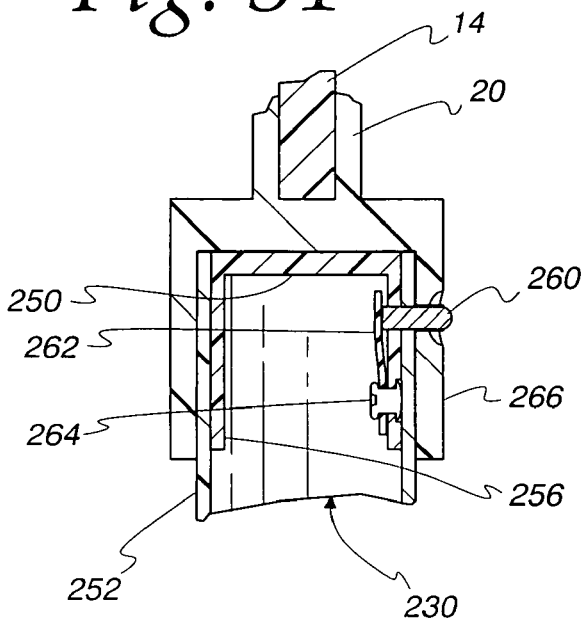
FIG. 31 is a fragmentary cross-sectional view taken along the line 31-31 of FIG. 30.
Figure 34:
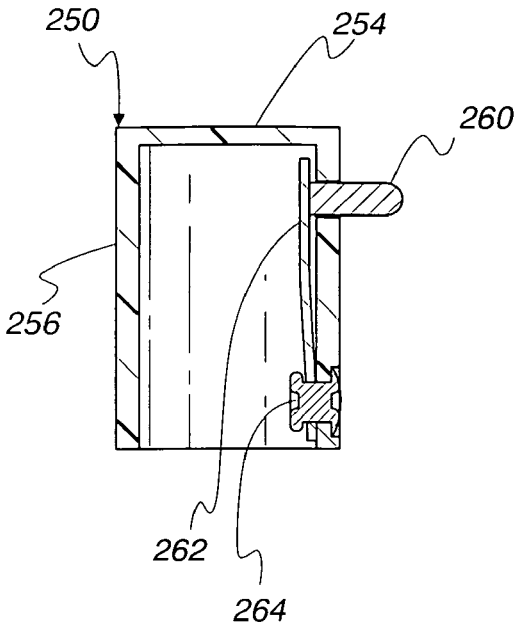
FIG. 34 is a fragmentary cross-sectional view taken along the line 34-34 of FIG. 30.

Referring now to FIGS. 31 and 34, upper mast section 230 includes an end cap 250 that encloses the upper end of the tubular body 252. As can be seen in FIG. 30, end cap 250 includes an end wall 254 that is generally flush with tubular body 256 of the end cap. A stop pin 260 is carried at one end of a finger-like spring bias member 262 that is secured to tubular body 56 by a rivet or other fastener 264. Stop pin 260 is dimensioned to extend through tubular body 252 of the mast section as well as sidewall 266 of coupler 20. Thus, stop pin 260 releasably secures socket 20 to upper mast section 230. It is generally preferred that socket 20 be provided with a hole 68 for this purpose (see FIG. 1).

Figure 32:
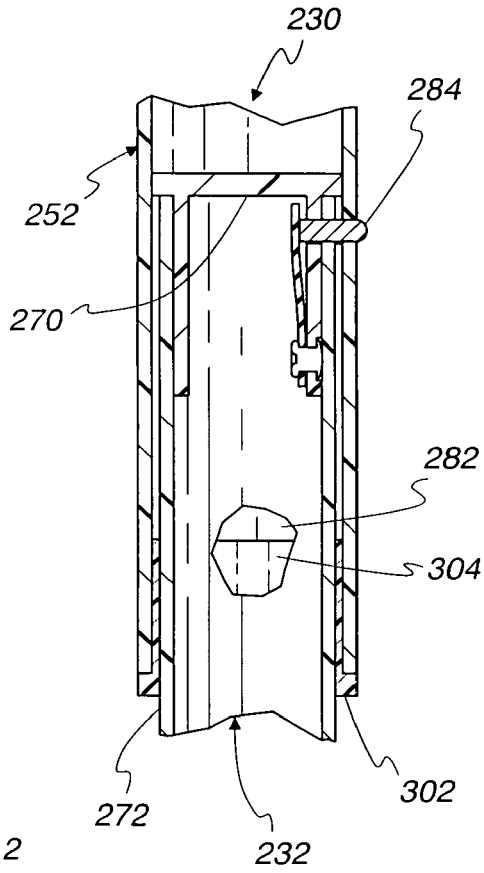
FIG. 32 is a fragmentary cross-sectional view taken along the line 32-32 of FIG. 30.
Figure 35:
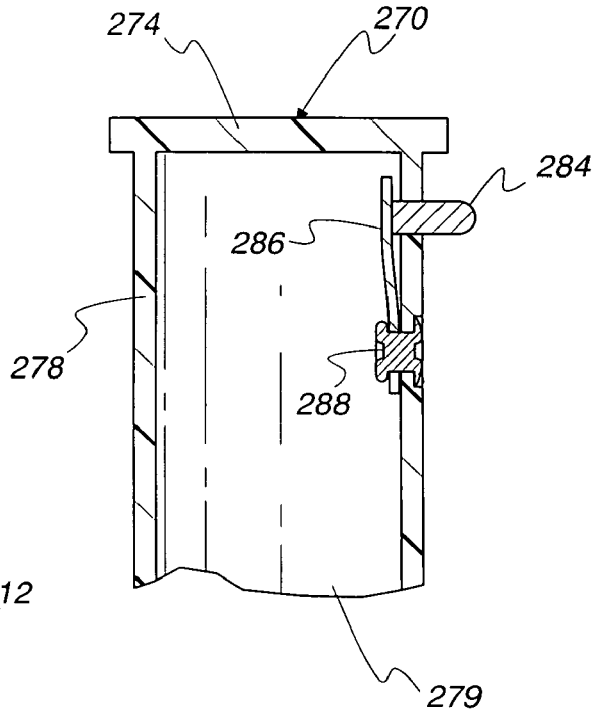
FIG. 35 is a fragmentary cross-sectional view taken along the line 35-35 of FIG. 30.

Referring now to FIGS. 32 and 35, the upper end of middle mast section 232 is enclosed by cap 270, joined to the upper end of tubular body 272 of middle mast section 232. As can be seen in FIG. 35, cap 270 includes and end wall 274, from which an inset sidewall 278 depends, extending in a downward direction. Preferably, sidewall 278 has a smaller diameter than end wall 274, so that the end wall overhangs the sidewall. As can be seen in FIG. 35, a lower end 279 of outer sidewall 278 presents a stop surface for cap 312, as will be explained below. A stop pin 284 is carried at one end of spring bias member 286, and a rivet 288 or other conventional fastener secures the remaining end of bias member 286 to sidewall 278. Preferably, stop pin 284 is dimensioned to extend through sidewall 78 and tubular wall 252 of upper mast section 230 (see FIG. 32).

Referring now to FIGS. 30 and 32, a stop member 302 is secured at the bottom end of tubular body 252, using adhesive or other conventional fastener. As can be seen in FIG. 30, stop member 302 has a sidewall 304 with an upper end 306 and an enlarged collar 308 at its lower end, to interfere with the bottom end of tubular body 252, thus limiting the amount of insertion of sidewall 304 into tubular body 252. Sidewall 304 has an internal bore dimensioned to receive tubular body 272, but not the outer sidewall of cap 270. Thus, with reference to FIG. 32, stop member 302 traps cap 270 within the tubular body 252 of upper mast section 230, when the upper end of sidewall 304 contacts the underside surface of the overhanging portion of top wall 274 (see FIG. 35). Referring again to FIG. 32, the cutaway portion shows the upper end of sidewall 304 and the interior surface 282 of wall 252. With brief reference to FIG. 31, the bottom end of tubular body 256 acts as a stop for cap 270, limiting the upward travel of mast section 232 within mast section 230.

Figure 33:
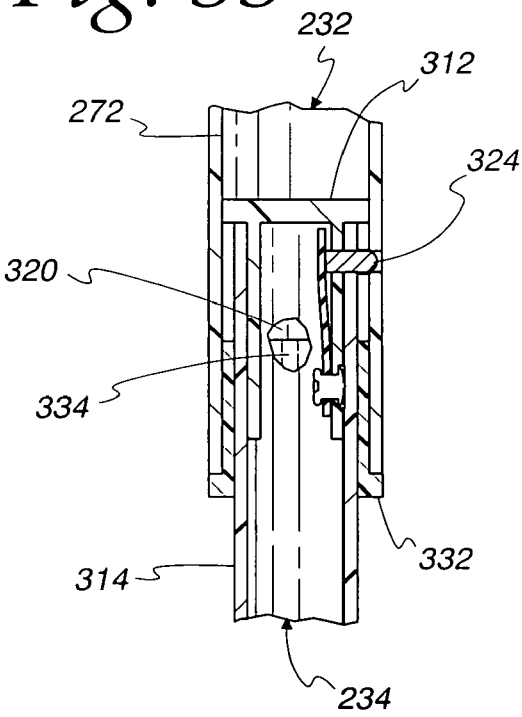
FIG. 33 is a fragmentary cross-sectional view taken along the line 33-33 of FIG. 30.
Figure 36:
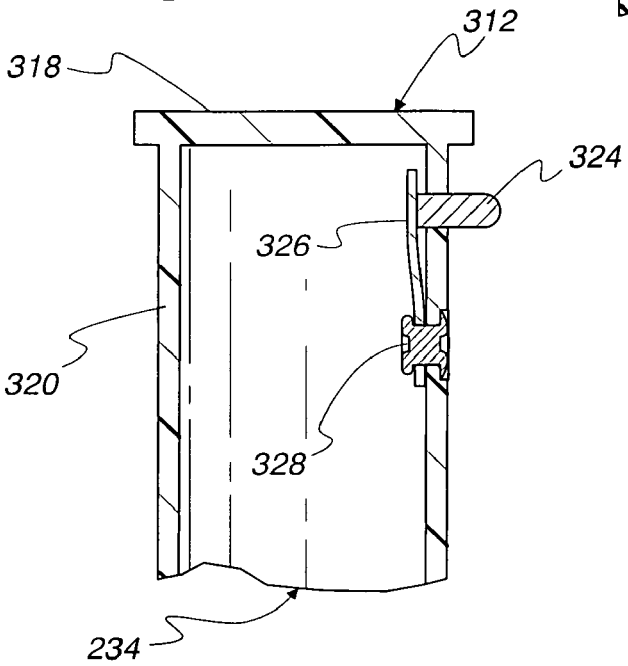
FIG. 36 is a fragmentary cross-sectional view taken along the line 36-36 of FIG. 30.
Figure 37:
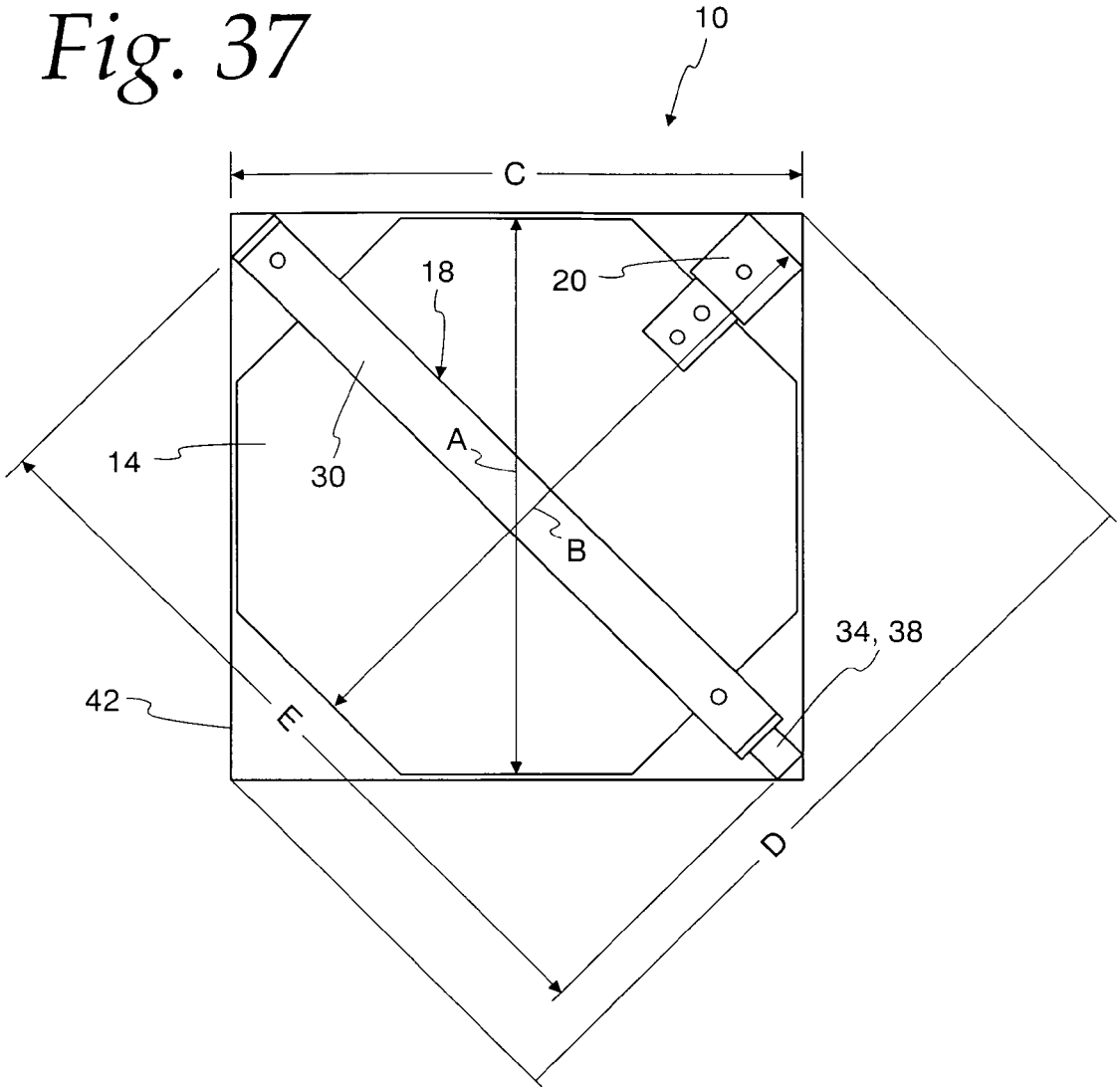
FIG. 37 is a top plan view of the sign kit of FIG. 1.

Turning now to FIGS. 33 and 36, an end cap 312 encloses the upper end of tubular body 314 of lower mast section 234. End cap 312 includes an end wall 318, from which a recessed or inset sidewall 320 depends. Preferably, end wall 318 overhangs sidewall 320 A stop pin 324, carried at one end of spring bias member 326 is dimensioned to pass through tubular body 314 as well as sidewall 320 and beyond, past sidewall 272 (see FIG. 33).

Referring now to FIGS. 30 and 33, a stop member 332 is affixed to the bottom end of tubular body 272 of middle mast section 232, preferably using an adhesive, although other conventional fasteners could be employed, as well. As can be seen in FIG. 30, stop member 332 includes a sidewall 334 having an upper end 336, and an enlarged collar 338. With reference to FIG. 33, sidewall 334 has an internal bore for receiving the tubular wall 314 of lower mast section 234, while being dimensioned for insertion into the bottom end of tubular wall 272 of middle mast section 232. Enlarged collar 338 limits this insertion. Thus, stop member 332 traps cap 312 within tubular body 272 of middle mast section 232. Downward travel of mast section 234 within mast section 232 is limited by contact of the underneath surface of the overhanging portion of cap 312 with the upper end of sidewall 334. Referring to FIG. 33, the cutaway portion of FIG. 32 shows the upper end of sidewall 334 and the inner surface 273 of sidewall 272. Upward travel of mast section 234 within mast section 232 is limited by contact of cap 312 with the bottom end 279 of sidewall 278 (see FIG. 35).

With reference to FIGS. 28-30, assembly of the mast sections 230-234, is illustrated, but for the stop members 302, 332 that form part of the upper and middle mast sections 230, 232, respectively. As indicated in FIG. 28, end cap 250 is fitted to tubular body 252. Cal) 270 is fitted to the upper end of tubular wall 272, and the subassembly is inserted into the lower end of tubular wall 252, as indicated by arrow 340 of FIG. 28, to form the subassembly shown at the top portion of FIG. 29. Thereafter, end cap 302 is secured to the bottom end of tubular body 252, trapping end cap 270 within tubular wall 252. End cap 312 is then fitted to the upper end of tubular sidewall 314, and the resulting subassembly is then inserted into the bottom end of tubular body 272, passing in the direction of arrow 344 (see FIG. 29), through the inner bore of stop member 302 (see FIG. 27). Before tubular body 272 is fully inserted, stop member 332 is affixed to its bottom end, using adhesive, or other fasteners. As can be seen, for example, in FIG. 27, stop member 332, while being free to pass within stop member 302, traps end cap 312 within tubular body 272. FIG. 27 shows the collapsed mast 218, ready for storage or transport.

Turning now to FIG. 34, various dimensions of the kit 10 of FIG. 1 are indicated. In one example, sign panel 14, with coupler 20 and mast 18 are received in a square carton 42 having a side dimension C of 18.25 inches and a diagonal length D of 25 15/16 inches. Sign panel 14 has a lateral dimension A of 18 inches, and socket 20 has a length of 2.75 inches. Accordingly, dimension B is 20.75 inches. Mast 18 has an overall length E of 24 3/8 inches. When assembled, the top of the sign panel is 7 feet, 9 1/2 inches above grade, with the bottom of mast 18 resting at grade level.

Referring to FIG. 6, in one example, mast 18 is made from conventional polyvinyl chloride water pipe, with mast sections 30, 32 and 34 made from nominal schedule 40 PVC pipe with sizes of 2 inch, 1.5 inch and 1 inch, respectively. The 2 inch pipe has a nominal outside diameter (O.D.) of 2.375 inches and a nominal inside diameter (I.D.) of 2.067 inches. The 1 1/2 inch pipe has an O.D. of 1.900 and an I.D. of 1.610 inches, while the 1 inch pipe has an O.D. of 1.315 inches and an I.D. of 1.049 inches. The mast sections 30, 32 and 34 have overall lengths of 29.6 inches, 27.4 inches and 26.6 inches, respectively. The overlap between mast sections 30 and 32 is 5.58 inches and the overlap between mast sections 32 and 34 is 3.9 inches. When full collapsed, mast 18 has a length of 24 3/8 less the amount of exposure of the bottom of mast section 34 (see 38 in FIGS. 1 and 7, for example) which can be made variable, as desired, and preferably has a length of about approximately 3.5 inches or less.

The foregoing descriptions and the accompanying drawings are illustrative of the present invention. Still other variations and arrangements of parts are possible without departing from the spirit and scope of this invention.

What is claimed is:

1. A mast assembly for use with a sign panel, having opposed primary and secondary ends, a configurable between an extended position having a greater extended length and collapsed position having a lesser collapsed length, comprising:

Outer, middle and inner telescopically interfitted mast sections disposed one within the other with the middle mast section disposed between the outer and the inner mast sections, each mast section having a hollow tubular body with opposed primary and secondary ends;

five caps engaging respective ends of the mast sections;

first and second caps engaged with the primary and the secondary ends of the outer mast section, respectively;

third and fourth caps engaged with the primary and the secondary ends of the middle mast section, respectively;

a fifth cap engaged with the primary end of the inner mast section;

the first cap having and end wall and a tubular body having a first end joined to the end wall and a second opposed end with a stop surface engaging the third cap when the mast assembly is collapsed;

the second cap having an annular end wall and a tubular body having a first end joined to the end wall and a second opposed end with a stop surface engaging an outer stop surface of the third cap when the mast assembly is extended;

the third cap having an end wall and spaced-apart inner and outer tubular bodies each having a first end joined to the end wall and each having second opposed ends with respective inner and outer stop surfaces, with the inner stop surface engaging the fifth cap when the mast assembly is collapsed;

the fourth cap having an annular end wall and a tubular body having a first end joined to the end wall and a second opposed end with a stop surface engaging a stop surface of the fifth cap stop surface when the mast assembly is extended; and the fifth cap having and end wall and a tubular body having a first end joined to the end wall and a second opposed end with a stop surface.

2. The mast assembly according to claim 1 further comprising a stop pin carried on the inner tubular body of the third cap, engaging the outer mast section when the mast assembly is extended.

3. The mast assembly according to claim 1 further comprising a stop pin carried on the inner tubular body of the fifth cap, engaging the middle mast section when the mast assembly is extended.

4. The mast assembly according to claim 1 further comprising a stop pin carried on the tubular body of the first cap, engaging the outer mast section.

5. The mast assembly according to claim 4 further comprising a sign mounting cap for securing a sign panel to the mast assembly, the sign mounting cap engaging the stop pin carried on the tubular body of the first cap.

6. A hand-held ground-supported display device for warning passersby, comprising:

a self-supporting sign panel for displaying warning information, having opposed major surfaces and a maximum lateral dimension;

a mast assembly for use with the sign panel, having opposed primary and secondary ends, a greater extended length and a lesser collapsed length, including outer, middle and inner telescopically interfitted mast sections disposed one within the other with the middle mast section disposed between the outer and the inner mast sections, each mast section having a hollow tubular body with opposed primary and secondary ends and five caps engaging respective ends of the mast sections;

first and second caps engaged with the primary and the secondary ends of the outer mast section, respectively;

third and fourth caps engaged with the primary and the secondary ends of the middle mast section, respectively;

a fifth cap engaged with the primary end of the inner mast section;

the first cap having and end wall and a tubular body having a first end joined to the end wall and a second opposed end with a stop surface engaging the third cap when the mast assembly is collapsed;

the second cap having an annular end wall and a tubular body having a first end joined to the end wall and a second opposed end with a stop surface engaging an outer stop surface of the third cap when the mast assembly is extended;

the third cap having an end wall and spaced-apart inner and outer tubular bodies each having a first end joined to the end wall and each having second opposed ends with respective inner and outer stop surfaces, with the inner stop surface engaging the fifth cap when the mast assembly is collapsed;

the fourth cap having an annular end wall and a tubular body having a first end joined to the end wall and a second opposed end with a stop surface engaging the stop surface of the fifth cap stop surface when the mast assembly is extended;

the fifth cap having and end wall and a tubular body having a first end joined to the end wall and a second opposed end with a stop surface, a sign mounting cap for securing the sign panel to the mast assembly, the sign mounting cap engaging a stop pin carried on the tubular body of the first cap.

7. The display device according to claim 6 further comprising a stop pin carried on the inner tubular body of the third cap, engaging the outer mast section when the mast assembly is extended.

8. The display device according to claim 6 further comprising a stop pin carried on the inner tubular body of the fifth cap, engaging the middle mast section when the mast assembly is extended.

* * * * *

UNITED STATES PATENT AND TRADEMARK OFFICE

CERTIFICATE OF CORRECTION

PATENT NO. : 7,681,349 B2
APPLICATION NO. : 12/070989
DATED : March 23, 2010
INVENTOR(S) : Grant D. Dicke and Richard Norman Dunbar It is certified that error appears in the above-identified patent and that said Letters Patent is hereby corrected as shown below:

Column 1, Line 7 - "filed Sep. 20, 2007," should be --filed Nov. 20, 2007,--;

Column 1, Line 45 - "a coupling joints." should be --coupling joints;--;

Column 1, Line 57 - There should be a --.-- at the end of the sentence;

Column 2, Line 52 - There should be a --.-- at the end of the sentence instead of a ";";

Column 4, Line 58 - "one within the other," should be --one within the other.--;

Column 5, Line 14 - There should be a --.-- at the end of the sentence, not a ";";

Column 5, Line 43 - "cap 70 includes and" should be --cap 70 includes an--;

Column 6, Line 17 - "tubular wall 14" should be --tubular wall 114--;

Column 6, Line 19 - "enlarged collar 138" should be --Enlarged collar 138--;

Column 7, Line 24 - "an seating ring" should be --a seating ring--;

Column 8, Line 38 - "includes and end wall 274," should be --includes an end wall 274,--;

Column 9, Line 5 - "overhangs sidewall 320" should be --overhangs sidewall 320.--;

Signed and Sealed this
Fourth Day of January, 2011

David J. Kappos

David J. Kappos
*Director of the United States Patent and Trademark Office*